US006925656B2

(12) United States Patent
Henderson

(10) Patent No.: US 6,925,656 B2
(45) Date of Patent: Aug. 9, 2005

(54) MAGNETIC SHOULDER STRAP RETAINER

(75) Inventor: George H. Henderson, Nampa, ID (US)

(73) Assignee: Regency Ventures, Inc., Nampa, ID (US)

( * ) Notice: Subject to any disclaimer, the term of this patent is extended or adjusted under 35 U.S.C. 154(b) by 23 days.

(21) Appl. No.: 10/643,522

(22) Filed: Aug. 18, 2003

(65) Prior Publication Data

US 2005/0039243 A1 Feb. 24, 2005

(51) Int. Cl.[7] ..... A41F 19/00
(52) U.S. Cl. ..... 2/310; 24/303
(58) Field of Search ..... 2/459, 44, 45, 2/267, 268, 310, 326–328, 247, 249, 250, 251; 24/303

(56) References Cited

U.S. PATENT DOCUMENTS 1,037,381 A * 9/1912 Wennerstrom ..... 224/264
4,017,944 A * 4/1977 Cohen ..... 24/366
4,121,324 A * 10/1978 Marbacher ..... 24/303
4,182,470 A 1/1980 Atkinson
4,882,815 A 11/1989 Nilsen
5,186,373 A 2/1993 Taylor
5,682,648 A 11/1997 Miller
6,006,455 A 12/1999 Miller
6,035,449 A * 3/2000 Galler et al. ..... 2/249
6,216,275 B1 4/2001 Lee
6,224,537 B1 5/2001 Shin
6,461,015 B1 10/2002 Welch

* cited by examiner

*Primary Examiner*—Tejash Patel
(74) *Attorney, Agent, or Firm*—Derek H. Maughan; Dykas, Shaver & Nipper

(57) ABSTRACT

A shoulder strap retaining device configured to assist in retaining a shoulder strap or other similar device in a desired position upon a person. The retaining device is made up of a combination of a first magnet located within a padded container that is configured to be placed against a person's skin and a second magnet that is configured to be placed over an individual's clothing. The magnets mutually attract one another and hold a shoulder strap in a desired position upon a person's shoulder.

4 Claims, 2 Drawing Sheets

MAGNETIC SHOULDER STRAP RETAINER

BACKGROUND OF THE INVENTION

1. Field of the Invention

The present invention generally relates to over the shoulder straps and more particularly to a device for retaining a strap in a desired position over the shoulder of an individual.

2. Background Information

Many individuals utilize carrying containers such as purses, backpacks, newspaper carriers, etc., which are worn over the shoulder. One of the problems that occurs with the use of such devices is that over time the shoulder strap has a tendency in many situations to slip down off of the shoulder. As a result, the container that is connected to the strap oftentimes falls to the ground. This is particularly true in the case of women's purses, which may have more narrow carrying straps than other carrying devices.

When the purse strap slips, the purse will typically fall and the contents of the purse may be lost or spilled. In addition, depending upon the length of the carrying strap, the purse may also cause problems with the individual's ability to walk or may interfere with their balance. This is in many instances bothersome to the individual carrying the purse or other similar device.

Therefore what is needed is a device that can be utilized to retain a shoulder strap in a desired position and orientation upon a person. What is also needed is a shoulder strap retaining device that can be easily added to or removed from a person's clothing without damage to the clothing.

Accordingly, it is an object of the present invention to fulfill the need of the aforementioned items. It is an additional object of the present invention to provide a means for attaching decorative or functional items to the clothing of an individual without incurring damage to the article of clothing.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention is a shoulder strap retaining device configured to assist in retaining a shoulder strap or other similar device in a desired position upon a person. The retaining device is made up of a first magnet encased within a padded container. The combination of the first magnet and the padded container is configured to be placed against a person's skin. In use, this first magnet is placed beneath an individual's clothing next to their body in a desired position. The second magnet is configured for placement over the outer portion of an individual's clothes and to magnetically attract to the first magnet. The first and second magnets are each further configured to mutually attract one to another. When the first and second magnets are placed in close proximity, the magnets attract and are pulled together. This mutual attraction allows the magnets to be maintained in a desired position upon an article of clothing without damage thereto. The second magnet is of sufficient size so that when the device is placed upon a shoulder or other similar body part, it prevents a shoulder strap from slipping off of the person's shoulder.

The purpose of the foregoing abstract is to enable the United States Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measure by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
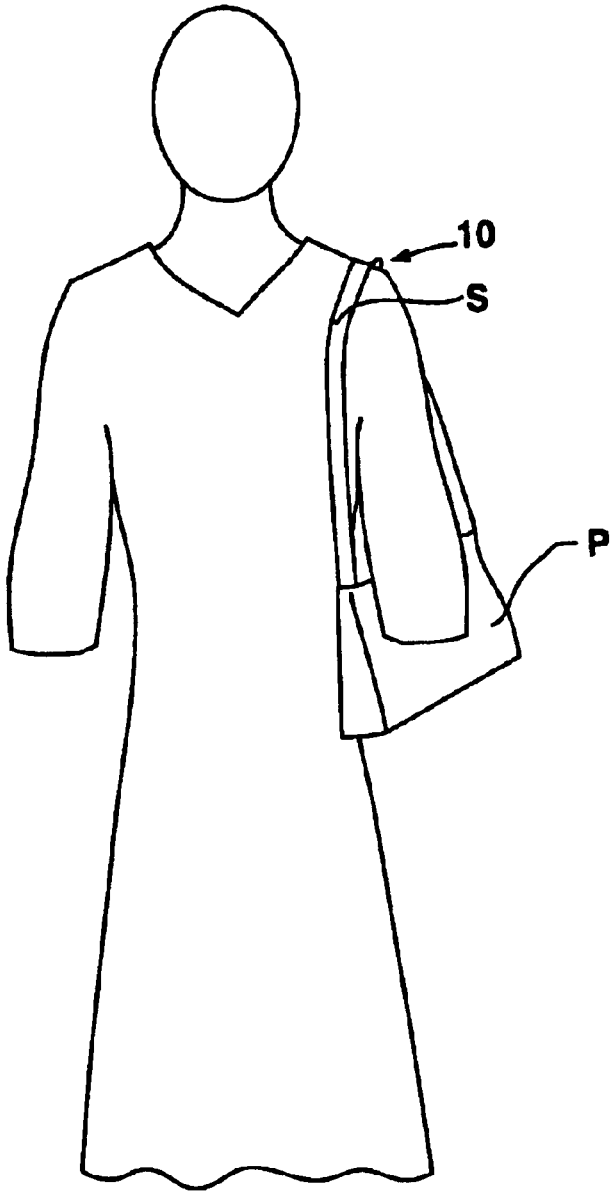
FIG. 1 shows a perspective view of the present embodiment of the present invention in use upon an individual utilizing a purse.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is a shoulder strap retaining device configured to magnetically attach to a person's clothing and to hold a retaining device, such as a shoulder strap, in a desired position and orientation. FIGS. 1–4 demonstrate various features of this preferred embodiment of the present invention.

Referring first to FIG. 1, shown is a perspective view of the present embodiment of the present invention in use upon an individual utilizing a purse. In this figure, an individual W, in this case intended to have the appearance of a woman, is shown carrying a purse P. This purse P is held over the person's shoulder by a strap S. The present invention 10 is positioned on either side of the clothing located near a person's shoulder and acts as a knob, which prevents the strap S from sliding off the person's shoulder.

Figure 2:
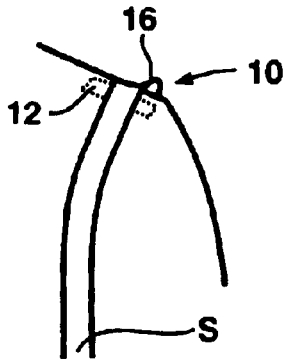
FIG. 2 is a front, detailed, perspective view of the embodiment shown in FIG. 1.

FIG. 2 shows a front, detailed, perspective view of the embodiment shown in FIG. 1. In this embodiment, the retaining device 10 is made up of a first magnet 12. This first magnet 12 is positioned beneath an article of clothing and is magnetically connected to a second magnet 16. Preferably, the first magnet is a generally bar shaped device and is covered with a covering that permits for a more comfortable fit between the person and the magnet. Typically, this device is removable so as to allow a person utilizing the device to insert and remove the device as desired.

A second magnet 16 is configured to rise a sufficient distance above the surface of the clothing so as to prevent the shoulder strap S from sliding in a downward direction from a position upon a person's shoulder. This second magnet 16 is also configured to be mutually attracted to the first magnet 12. In use, the first 12 and second 16 magnets are brought into close proximity and, as a result, are mutually attract one to another. Thus mutual attraction holds the magnets in a desired position on the clothing of an individual, which prevents the device from slipping therefrom. This also prevents any damage from occurring to the clothing of the individual.

Figure 3:
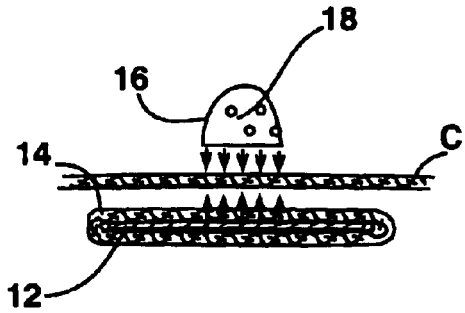
FIG. 3 is a front plan view of the present invention.

FIG. 3 shows a front, plan view of the present invention. The first magnet 12, which is configured to be generally elongated and bar shaped, is covered with protective covering 14. The protective covering 14 is embodied so as to provide a padded layer between the individual utilizing the device and the magnet 12, which is located within the padded covering 14. The second magnet 16 is configured to have a variety of adornment pieces 18 connected to it. These adornment pieces include, but are not limited to, advertising, displays, insignia, jewelry, and other forms of decorative adornment.

In use, the first magnet 12 is inserted beneath an individual's clothing in a position between the person's skin and the clothing. The second magnet 16 is then placed above the clothing in proximity to the first magnet 12. When this occurs, the mutually attractive magnetic forces between the first 12 and second 16 magnets pull the magnets together so as to form a strong magnetic bond in a desired position and orientation. In the preferred embodiment, at least one of the magnets, preferably the second magnet 16, is a neodymium magnet. These magnets are of particularly high strength and provide a strong, reliable connection between the two magnetic portions 12, 16.

This connection maintains the magnets in a strong location and prevents an item such as a shoulder strap from passing over the device. When use of this device is no longer desired, the magnets can be removed by sliding the magnets apart. The magnets can then be neatly stored together in a storage location such as within the individual's purse.

Figure 4:
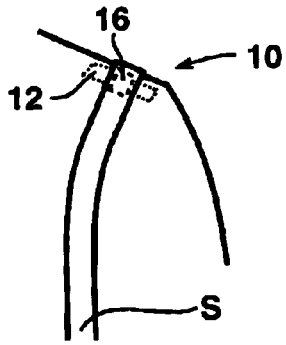
FIG. 4 is an alternative embodiment of the present invention.

In other embodiments, such as the embodiment shown in FIG. 4, the second magnet 16 may be sewn within a strap portion S. While the present invention is shown in the embodiment of utilizing a purse, it is to be distinctly understood that the embodiment is not limited thereto, but may be variously embodied to perform a variety of decorative and functional features.

FIG. 4 is an alternative embodiment of the present invention wherein the second magnet 16 is located with a portion of the strap s of the device.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A shoulder strap retaining device configured to assist in retaining a shoulder strap or other similar device in a desired position upon a person said retaining device comprised of:

a first neodymium magnet encased within a padded container said first magnet and said padded container configured to be placed against a person's skin; and a second magnet, said second magnet having a projecting adornment attached thereto said second magnet configured for placement over the outer portion of an individual's clothes, said second magnet and said first magnet further configured to mutually attract one to another and to hold and maintain said second magnet in a desired position and orientation upon the shoulder of the person utilizing the device, whereby said second magnet forms a projection extending from an article of clothing said second magnet configured to maintain said shoulder strap in a desired position and location.

2. The shoulder strap retaining device of claim 1 wherein said second magnet is configured for insertion within a desired portion of a shoulder strap.

3. The shoulder strap retaining device of claim 2 wherein said second magnet is configured to also have a decorative adornment.

4. The decorative clothing attachment device of claim 1 wherein said second magnet is a neodymium magnet.

* * * * *